US008985193B2

(12) United States Patent
Hirsch et al.

(10) Patent No.: US 8,985,193 B2
(45) Date of Patent: Mar. 24, 2015

(54) HEAT EXCHANGER

(75) Inventors: Stefan Hirsch, Stuttgart (DE); Kurt Molt, Bietigheim (DE); Uwe Foerster, Erdmannhausen (DE)

(73) Assignee: Behr GmbH & Co. KG, Stuttgart (DE)

( * ) Notice: Subject to any disclaimer, the term of this patent is extended or adjusted under 35 U.S.C. 154(b) by 0 days.

(21) Appl. No.: 13/401,482

(22) Filed: Feb. 21, 2012

(65) Prior Publication Data

US 2012/0211495 A1 Aug. 23, 2012

Related U.S. Application Data

(63) Continuation of application No. PCT/EP2010/061365, filed on Aug. 4, 2010.

(30) Foreign Application Priority Data

Aug. 21, 2009 (DE) ..... 10 2009 038 297

(51) Int. Cl.
*F28F 9/02* (2006.01)

(52) U.S. Cl.
CPC ..... *F28F 9/0224* (2013.01); *F28F 2275/12* (2013.01)
USPC ..... 165/76; 165/149; 29/890.052

(58) Field of Classification Search
USPC ..... 165/149, 153, 173; 228/183; 29/890.053, 509, 510, 515
See application file for complete search history.

(56) References Cited

U.S. PATENT DOCUMENTS

| | | | | |
|---|---|---|---|---|
| 4,331,201 | A | 5/1982 | Hesse | |
| 4,461,348 | A | 7/1984 | Toge et al. | |
| 4,579,375 | A * | 4/1986 | Fischer et al. | 285/363 |
| 4,646,488 | A * | 3/1987 | Burns | 52/94 |
| 5,172,761 | A * | 12/1992 | Lyon | 165/173 |
| 5,195,579 | A * | 3/1993 | Buchanan | 165/149 |
| 5,297,624 | A * | 3/1994 | Haussmann et al. | 165/173 |
| 6,029,334 | A * | 2/2000 | Hartley | 29/464 |
| 6,675,883 | B1 * | 1/2004 | De Keuster et al. | 165/173 |
| 2003/0131981 | A1 * | 7/2003 | Kohler et al. | 165/178 |
| 2006/0113069 | A1 * | 6/2006 | Ninagawa et al. | 165/149 |
| 2006/0266509 | A1 * | 11/2006 | Forster et al. | 165/173 |
| 2007/0131392 | A1 * | 6/2007 | Minami et al. | 165/110 |
| 2010/0025028 | A1 * | 2/2010 | Shinhama et al. | 165/174 |

FOREIGN PATENT DOCUMENTS

| | | | |
|---|---|---|---|
| DE | 39 18 312 | A1 | 12/1990 |
| DE | 43 39 952 | A1 | 6/1995 |

(Continued)

*Primary Examiner* — Allen Flanigan
(74) *Attorney, Agent, or Firm* — Muncy, Geissler, Olds & Lowe, P.C.

(57) ABSTRACT

A heat exchanger having at least one collecting tank which extends in a longitudinal direction and which comprises a plate and a cover, wherein the plate has, at least one of its edge regions running in the longitudinal direction, a rim by means of which the plate engages at the outside over an edge region, which runs in the longitudinal direction, of the cover, or wherein the cover has, at least one of its edge regions running in the longitudinal direction, a rim by means of which the cover engages at the outside over an edge region, which runs in the longitudinal direction, of the plate. The respective rim have, in the longitudinal direction, a multiplicity of calked portions by means of which said rim, in the region of each individual calked portion, is deformed in the plate and the cover to one another.

21 Claims, 2 Drawing Sheets

(56) References Cited

FOREIGN PATENT DOCUMENTS

| | | | |
|---|---|---|---|
| DE | 10 2006 040 848 | A1 | 3/2007 |
| DE | 10 2006 057 585 | A1 | 6/2007 |
| DE | 10 2006 053 702 | A1 | 5/2008 |
| EP | 0 372 187 | A1 | 6/1990 |
| JP | 10 132485 | A | 5/1998 |
| JP | 2004 108613 | A | 4/2004 |
| JP | 2008 089188 | A | 4/2008 |
| WO | WO 2004/088234 | A2 | 10/2004 |
| WO | WO 2007/028542 | A1 | 3/2007 |

* cited by examiner

HEAT EXCHANGER

This nonprovisional application is a continuation of International Application No. PCT/EP2010/061365, which was filed on Aug. 4, 2010, and which claims priority to German Patent Application No. DE 10 2009 038 297.6, which was filed in Germany on Aug. 21, 2009, and which are both herein incorporated by reference.

BACKGROUND OF THE INVENTION

1. Field of the Invention

The invention relates to a heat exchanger, particularly a gas cooler, having at least one collecting tank, which extends in a longitudinal direction and comprises a base and a cover and has at least two longitudinal channels, substantially circular in cross section, which are spaced apart at least in sections by at least one longitudinal partition wall formed by the base and/or cover, whereby the base, at at least one of its edge regions running in the longitudinal direction, has a rim by means of which the base overlaps on the outside an edge region, running in the longitudinal direction, of the cover or whereby the cover, at at least one of its edge regions running in the longitudinal direction, has a rim by means of which the cover overlaps on the outside an edge region, running in the longitudinal direction, of the base.

2. Description of the Background Art

WO 2004/088234 A2 discloses a generic heat exchanger in which the rim is formed by a continuous tab. After the cover is placed on the base, the rim is bent or folded in order to fix both parts to one another before a soldering process. This calls for a high material requirement and high forces for the bending or folding, however, whereby the joining forces, which predominate after the bending or folding between the base and cover, are small owing to the elastic deformation of the rim.

DE 10 2006 053 702 A1 discloses a collecting tank in which the rim is formed by individual tabs. Here as well, after placement of the cover on the base, the rim is bent or folded to fix both parts to one another. The joining forces between the base and cover are small, however, because of the thinning of material and elastic deformation of the rim.

SUMMARY OF THE INVENTION

It is therefore an object of the present invention to provide a heat exchanger, which is constructed simply and expediently with a secure joining and can be produced cost-effectively.

The object is attained by a heat exchanger of the invention, in which the respective rim in the longitudinal direction has a plurality of peened portions, by means of which said rim is deformed in the area of each individual peened portion in the direction of the collecting tank center and fixes the base and cover to one another. Preferably, the cover and base are stamped from a sheet metal blank and each have a substantially w form or ω form in cross section. Because of this form, the base and cover are in contact in their outer areas and in their center, as a result of which a longitudinal partition wall is formed.

The two opposite rims can be basically angled outward in the areas in which they have no peened areas. It is preferred, however, that the two rims run parallel to one another in the area in which they have no peened areas. It is of particular advantage that through the plurality of peened portions a strong joining of the cover and base is attained with low material usage.

It has proven advantageous, when the plurality of peened portions is arranged symmetrical relative to the collecting tank center. As a result, the joining of the cover and base has a symmetric force profile, which increases the quality of the joining.

In a refinement of the invention, two peened portions, adjacent in the longitudinal direction, have the same or different widths. Moreover, it has proven advantageous, when the peened portions arranged in the longitudinal direction have a similar or different distance to one another. In areas of the collecting tank in which, because of the expected stress, a stronger joining of the collecting tank is necessary, this can be assured in a simple manner by increasing the width of the peened portion or by the number of peened portions within the relevant area. The geometry of the individual peened portions is basically arbitrary in this case. Straight portions and angular or round designs are possible.

Further, it has proven advantageous, when an individual peened portion has a width of 0.5-6 mm, particularly 0.75-5 mm, particularly 1-4 mm. Point peened portions are achieved in this way, whereby the force necessary for this to produce the peened portion is reduced.

In a refinement of the invention, one peened portion or a plurality of peened portions forms a seat for at least one connecting piece, particularly a flange or retainer. The connecting piece, particularly flange or retainer, can be hooked, for example, into the peened portion. It is preferable, however, that the connecting piece is clamped by the peened portion.

Advantageously, the base and the cover are soldered together. As a result, the heat exchanger can withstand high pressures and be used, for example, in a CO2 refrigeration circuit.

Further, it is provided in a refinement of the invention that the heat exchanger has a plurality of flat tubes forming a heat exchange surface, whereby the flat tubes have tube ends and the base has openings, corresponding to the number of flat tubes, for receiving the tube ends.

It has proven advantageous, when the rim of the base is higher than the outer edge of the cover or the rim of the cover is higher than the outer edge of the base. The rim of the base engages behind the cover in the area of a peened portion or the rim of the cover engages behind the base in the area of a peened portion. In such cases, it is preferred if the height of the rim of the base over the edge of the cover or the height of the rim of the cover over the edge of the base is 0.5-4 mm, particularly 0.75-3 mm, particularly 1-2.5 mm, particularly 1-1.5 mm.

Ultimately, an exemplary embodiment of the invention is preferred in which the peened portions in the corner areas form a positioning device for the collecting tank in the longitudinal direction.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 4:
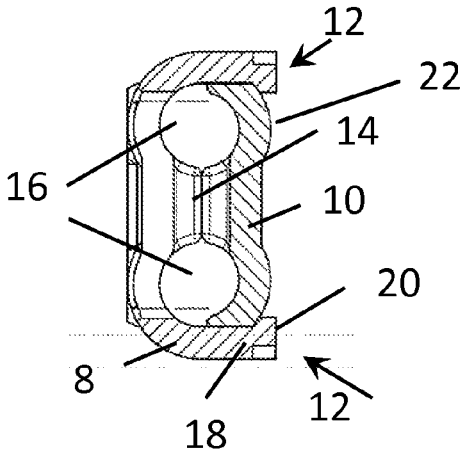
FIG. 4 shows a sectional view along section I-I according to FIG. 3.
Figure 5:
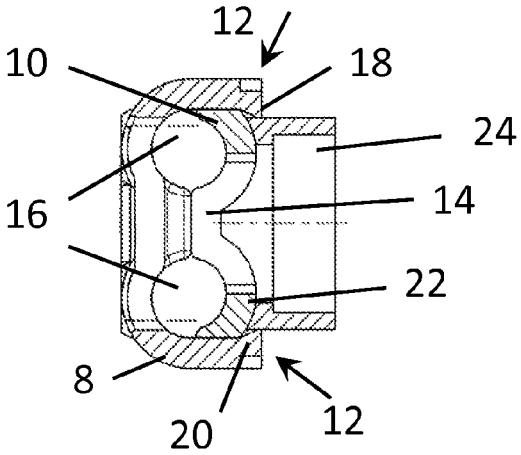
FIG. 5 shows a sectional view along section II-II according to FIG. 3.

The figures show an assembly of a heat exchanger, provided as a whole with the reference number 2, particularly a gas cooler. Heat exchanger 2 comprises a collecting tank 6, which extends in a longitudinal direction 4 and which is formed from a base 8 and a cover 10. Base 8 and cover 10 are stamped out of a sheet metal plate and have a w- or ω-shaped cross section. Base 8 and cover 10 contact one another in their edge regions 12 and in their center and there form an at least almost closed longitudinal partition wall 14 for longitudinal channels 16 extending in the longitudinal direction 4 (FIGS. 4 and 5).

In the exemplary embodiment shown in the figures, base 8 at its edge regions 12, extending in the longitudinal direction 4, has a rim 18, which overlaps cover 10 on the outside. In the longitudinal direction 4, rim 18 has a plurality of peened portions 20 at which rim 18 of base 8 is deformed in the direction toward the center of collecting tank 6 and lies against cover 10, as a result of which cover 10 and base 8 are fixed to one another.

Figure 1:
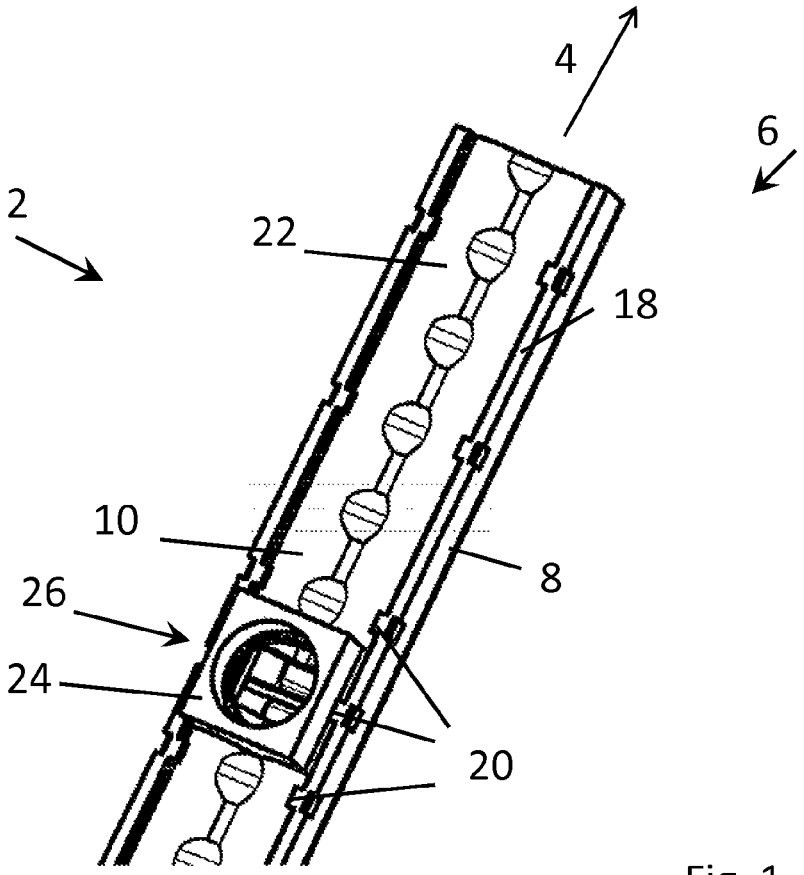
FIG. 1 shows a perspective view of a collecting tank of a heat exchanger of the invention.
Figure 2:
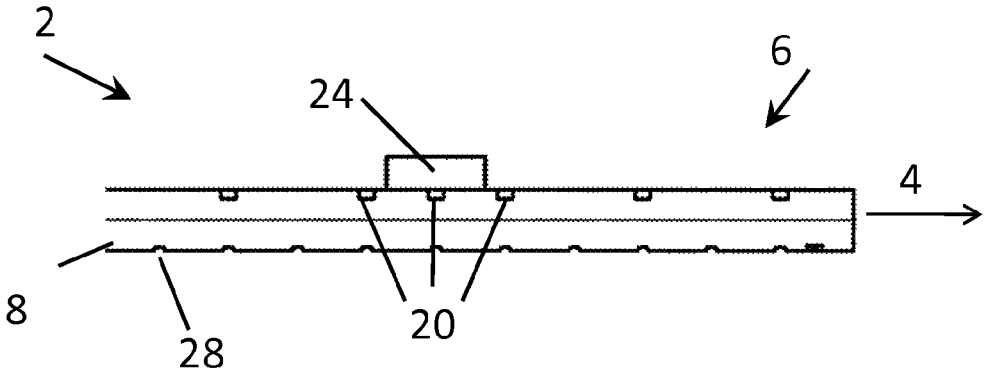
FIG. 2 shows a side view of the collecting tank according to FIG. 1.
Figure 3:
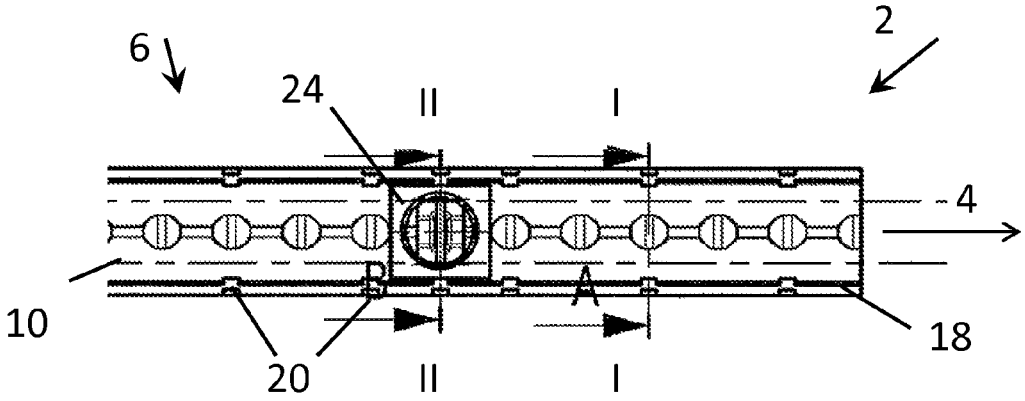
FIG. 3 shows a plan view of the collecting tank according to FIG. 1.

FIGS. 1, 2, and 3 show collecting tank 6 from different views. Rims 18 run parallel to one another and are higher than the outer edge 22 of cover 10. Peened portions 20 lie against the outer edge 22 of cover 10, so that base 8 engages behind cover 10 in the area of peened portions 20 perpendicular to the longitudinal direction 4. Peened portions 20 are arranged symmetrically to the center of collecting tank 8 and have substantially the same width. Peened portions 20 have a geometry, which has predominantly straight and angular sections.

In the shown exemplary embodiment, connecting piece 24 is connected to collecting tank 6 via a seat 26 formed by one of the peened portions 20. To this end, the distance of two peened portions 20, adjacent in the longitudinal direction 4, is smaller than in areas in which no connecting piece 24 is accommodated.

On the side of base 8, said side facing away from rim 18, openings 28 are arranged, in which a plurality of flat tubes (not shown) forming a heat exchanger surface can be inserted with their tube ends.

The joining of heat exchanger 2 is explained below with reference to FIGS. 4 and 5.

Base 8 and cover 10 are stamped out of a sheet metal plate and formed into a w or ω shape. To join the two parts, cover 10 is arranged within base 8 and overlapped by it on its edge regions 12 from outside by rim 18. Cover 10 and base 8 contact one another in each case in their center and as a result form the longitudinal partition wall 14, which spaces apart the two longitudinal channels 18. With the introduction of peened portions 20 into rim 18, base 8 and cover 10 are pressed against one another and joined together.

In the shown exemplary embodiment, rim 18 of base 8 is higher than the outer edge 22 of cover 10 and runs parallel to the opposite rim 18 in the areas in which there is no peened portion 20. As a result, peened portion 20 engages behind cover 10 and presses it against base 8.

FIG. 5 shows a section along line II-II according to FIG. 3 in which a connecting piece 24 is arranged at the level of a peened portion 20 formed as a seat 26. Connecting piece 24 lies on one side against the outer edge 22 of cover 10 and is clamped laterally by peened portions 20, so that it is fixed on collecting tank 6.

A process-reliable joining of collecting tank 6 including connecting pieces 24 is achieved by peened portions 20.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A heat exchanger comprising:

at least one collecting tank that extends in a longitudinal direction and comprises a base and a cover, the base at least one of its edge regions runs in the longitudinal direction; and a rim via which the base overlaps on an outside of an edge region running in the longitudinal direction of the cover or whereby the cover at least one of its edge regions running in the longitudinal direction has a rim via which the cover overlaps on the outside an edge region running in the longitudinal direction of the base, wherein the respective rim is substantially linear in the longitudinal direction and is devoid of tabs or projections, wherein portions of the substantially linear rim are deformed in the direction of the collecting tank center to fix the base and the cover to one another, each deformed portion of the substantially linear rim forming a peened portion, such that a plurality of peened portions are provided, and wherein at least one area of the substantially linear rim has peened portions having a greater width than peened portions in other areas of the substantially linear rim.

2. The heat exchanger according to claim 1, wherein the plurality of peened portions is arranged symmetrically relative to the collecting tank center.

3. The heat exchanger according to claim 1, wherein two peened portions, adjacent in the longitudinal direction, have the same width.

4. The heat exchanger according to claim 1, wherein an individual peened portion has a width of 0.5-6 mm.

5. The heat exchanger according to claim 1, wherein the peened portions, arranged in the longitudinal direction, have a similar or a different distance to one another.

6. The heat exchanger according to claim 1, wherein one or more peened portions form a seat for at least one connecting piece, a flange, or retainer.

7. The heat exchanger according to claim 6, wherein the connecting piece is fixed at least one of its ends by a peened portion.

8. The heat exchanger according to claim 6, wherein the connecting piece is fixed at both ends each by a peened portion.

9. The heat exchanger according to claim 1, wherein the base and the cover are soldered together.

10. The heat exchanger according to claim 1, wherein the rim of the base is higher than the outer edge of the cover or the rim of the cover is higher than the outer edge of the base.

11. The heat exchanger according to claim 1, wherein a height of the rim of the base over the outer edge of the cover or a height of the rim of the cover over the outer edge of the base is 0.5-4 mm.

12. The heat exchanger according to claim 1, wherein the peened portions in the corner areas form a positioning device for the collecting tank in the longitudinal direction.

13. The heat exchanger according to claim 1, wherein at least two longitudinal channels substantially circular in cross section are provided, and are spaced apart at least in sections by at least one longitudinal partition wall formed by the base and/or cover.

14. The heat exchanger according to claim 1, wherein a height of the rim of the base over the outer edge of the cover or a height of the rim of the cover over the outer edge of the base is 0.75-3 mm.

15. The heat exchanger according to claim 1, wherein a height of the rim of the base over the outer edge of the cover or a height of the rim of the cover over the outer edge of the base is 1-2.5 mm.

16. The heat exchanger according to claim 1, wherein a height of the rim of the base over the outer edge of the cover or a height of the rim of the cover over the outer edge of the base is 1-1.5 mm.

17. A heat exchanger comprising:

at least one collecting tank that extends in a longitudinal direction and comprises a base and a cover, the cover having a longitudinal edge that extends along an inside wall of the base;

the base including a longitudinal edge folded over the cover to form a rim having a form;

the rim being substantially linear in the longitudinal direction and devoid of tabs or projections, wherein portions of the substantially linear rim are deformed in a direction of a centerline of the base, the deformed portions fixing the cover to the base, and wherein at least one area of the substantially linear rim has deformed portions having a greater width than deformed portions in other areas of the substantially linear rim.

18. The heat exchanger of claim 17, wherein the deformed portions comprise peened portions.

19. A method of forming a collecting tank of a heat exchanger comprising:

providing a collecting tank base having first and second longitudinal edges, at least one of the first and second edges being folded over to form a rim, the rim being substantially linear in the longitudinal direction and being devoid of tabs or projections;

placing a collecting tank cover in the collecting tank base such that the substantially linear rim overlies a longitudinal portion of the collecting tank cover; and deforming portions of the substantially linear rim in the direction of a centerline of the base to fix the cover to.the base, wherein at least one area of the substantially linear rim has deformed portions having a greater width than deformed portions in other areas of the substantially linear rim.

20. The heat exchanger according to claim 1, wherein an individual peened portion has a width of 0.75-5 mm.

21. The heat exchanger according to claim 1, wherein an individual peened portion has a width of 1-4 mm.

* * * * *